United States Patent [19]

Schwartz et al.

[11] Patent Number: 4,573,906

[45] Date of Patent: Mar. 4, 1986

[54] SHIELDED SMOKE SUPPRESSING FLARE GAS BURNER

[75] Inventors: Robert E. Schwartz; Roger K. Noble; Michael R. Keller, all of Tulsa, Okla.

[73] Assignee: John Zink Company, Tulsa, Okla.

[21] Appl. No.: 704,048

[22] Filed: Feb. 21, 1985

Related U.S. Application Data

[63] Continuation-in-part of Ser. No. 645,420, Aug. 29, 1984.

[51] Int. Cl.[4] ..... F23D 13/20

[52] U.S. Cl. ..... 431/202; 431/284

[58] Field of Search ..... 431/202, 278, 283, 284

[56] References Cited

U.S. PATENT DOCUMENTS

| | | | |
|---|---|---|---|
| 2,506,972 | 5/1950 | Schellentrager et al. | 431/202 |
| 2,537,091 | 1/1951 | Rodman et al. | 431/202 X |
| 2,779,399 | 1/1957 | Zink . | |
| 3,231,004 | 1/1966 | Reed . | |
| 3,730,673 | 5/1973 | Straitz | 431/202 X |

OTHER PUBLICATIONS

"Advanced in Offshore Flaring Technology", by Robert Schwartz & Horst Glomm, Presented at a Seminar on Flare Systems Arranged by the Norwegian Society of Chartered Engineers, 1982.

"Flaring in Hostile Environments", by Robert Schwartz and Michael Keller, Presented at a Seminar on Flare Systems Arranged by the Norwegian Society of Chartered Engineers, 1982.

*Primary Examiner*—Randall L. Green

*Attorney, Agent, or Firm*—C. Clark Dougherty, Jr.

[57] ABSTRACT

A smoke suppressing flare gas burner is provided which is less susceptible to damage caused by internal and/or external burning. An external protective covering is attached over the exterior of the burner as well as smoke suppressant and pilot flame conduits associated therewith whereby the burner is shielded from flame impingement and excessive heat and an aerodynamically improved exterior surface is provided on the burner.

13 Claims, 3 Drawing Figures

SHIELDED SMOKE SUPPRESSING FLARE GAS BURNER

CROSS-REFERENCE TO RELATED APPLICATION

This application is a continuation-in-part of Application Ser. No. 645,420 filed Aug. 29, 1984.

BACKGROUND OF THE INVENTION

1. Field of the Invention

The present invention relates generally to flare gas burners, and more particularly, but not by way of limitation, to an improved smoke suppressing flare gas burner adapted to be connected to a flare gas conduit or stack.

2. Description of the Prior Art

Flares are commonly utilized for disposing of gases, both waste gases and gases flared as a result of equipment shut-downs, plant upsets, etc. The flared gases are burned by a flare burner either continuously or intermittently, and to insure that the flared gases are ignited and that the burning thereof is maintained, continuously burning pilot flames are generally provided at the flare gas burner.

Flare burners utilized for flaring gases which produce smoke when burned have in many cases included provision for injecting a smoke suppressant such as steam or a steam-air mixture into the gases whereby smoke emissions therefrom are reduced or eliminated. The smoke suppressant can be injected from within the flare burner, but generally it has been found that for the most efficient and effective suppression, at least some of the suppressant should be injected into the burning zone from points around the periphery of the burner flare gas discharge end.

While a variety of flare gas burner designs and multiple burner arrangements have been developed and used heretofore, in applications where a high maximum flow rate of flare gas is to be handled by the flare, a single flare gas burner of relatively large diameter is often used. Unfortunately, most of such flares seldom, if ever, operate at the maximum flow condition, and consequently, the flares frequently handle gas flow rates which are only small fractions of the maximum. The low flow rates in combination with wind acting on the flare gas burner often cause internal and external burning which bring about the early failure of the burner.

Internal burning occurs as a result of wind blowing transversely to the longitudinal axis of a flare gas burner when a low rate of gas is flowing through the burner. The wind causes a low pressure zone to develop within the open discharge end of the burner which in turn causes air to be drawn into the burner. As the air and gas mix within the burner, internal burning takes place. Such internal burning can cause flame impingement and excessive heat damage to the internal walls of the burner which can and usually does drastically shorten the life of the burner.

While increased gas flow rates overcome the problem with internal burning, the combination of a gas flow rate which is still less than maximum and wind can bring about an undesirable condition of external burning. That is, as wind strikes a flare gas burner, a high pressure zone is developed on the windward side and a low pressure zone is developed on the leeward side. At certain less than maximum flow rates of gas through the flare gas burner, the low pressure zone created by the wind and the wind force against the flame above the burner cause a portion of the flame to move or to be pulled into the low pressure zone on the leeward side of the flare burner. This in turn brings about flame impingement and excessive heat damage to wall portions of the burner and its appurtenances.

Low pressure zones which promote external burning are also readily formed by wind acting on the portions of flare burners which extend outwardly from the external sides of the burners such as pilot flame burners and associated fuel gas conduits, ignitor apparatus, smoke suppressant nozzles and supply conduits and the like. External burning in such low pressure zones brings about damage to the burner as well as to the conduits and other protruding portions thereof.

By the present invention, an improved smoke suppressing flare gas burner is provided which is shielded from flame impingement, heat, etc., brought about by internal and/or external burning thereby significantly increasing the operational life of the burner.

SUMMARY OF THE INVENTION

A smoke suppressing flare gas burner adapted to be connected to a flare gas stack or conduit is provided. The burner is comprised of a tubular member having a discharge end and an inlet end, and an internal protective liner formed of refractory material is optionally attached within the tubular member at the discharge end portion thereof. A smoke suppressant manifold adapted for connection to a source of smoke suppressant is positioned exteriorly of the tubular member and a plurality of smoke suppressant conduits are connected to the manifold which extend exteriorly of the tubular member to points adjacent the discharge end thereof. Pilot flame burner means for igniting flare gas discharged from the tubular member are positioned adjacent the discharge end thereof. The pilot burner means are connected to conduit means for supplying fuel thereto and the conduit means are disposed exteriorly of the tubular member. An external protective convering formed of refractory material is attached over the plurality of smoke suppressant conduits, over the pilot fuel conduit means and over the exterior wall surface of the tubular member at the discharge end portion thereof whereby the conduits and exterior wall surface are shielded and an aerodynamically improved external surface is provided at the discharge end of the burner.

It is, therefore, a general object of the present invention to provide an improved smoke suppressing flare gas burner.

Another object of the present invention is the provision of a smoke suppressing flare gas burner which is shielded to reduce the damaging effects of flame impingement, excessive heat, etc., caused by internal and/or external burning.

A further object of the present invention is the provision of a smoke suppressing flare gas burner wherein the burner as well as pilot flame burner fuel gas, igniter and smoke suppressant conduits are shielded by protective coverings of refractory material to thereby substantially lessen damage resulting from internal and/or external burning and to provide an aerodynamically improved external surface on the burner.

Other and further objects, features and advantages of the present invention will be readily apparent to those skilled in the art upon a reading of the description of preferred embodiments which follows when taken in conjunction with the accompanying drawings.

DESCRIPTION OF THE PREFERRED EMBODIMENTS

Figure 1:
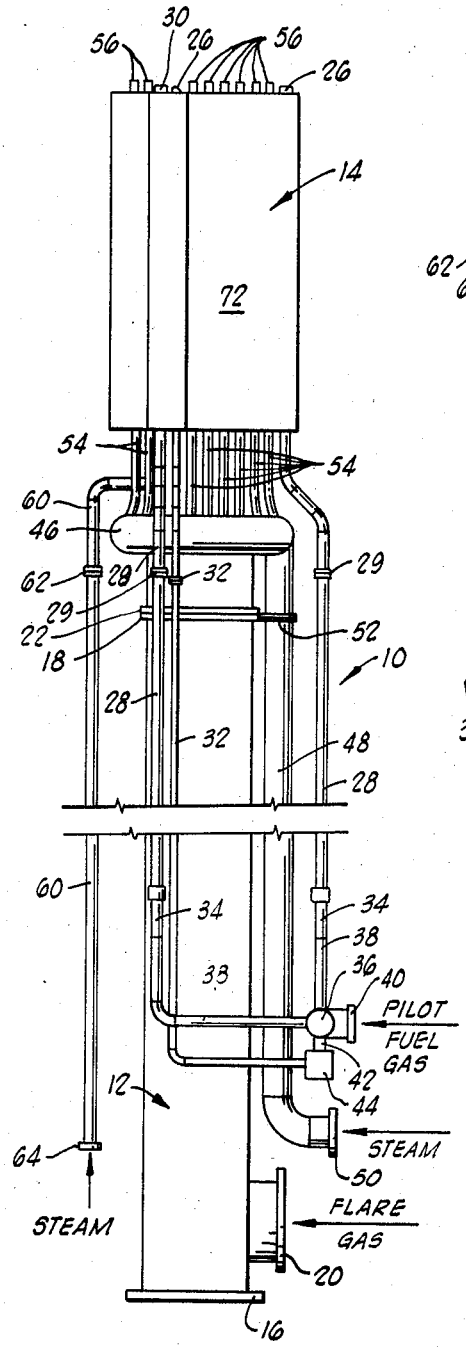
FIG. 1 is a side elevational view of a typical flare stack including the smoke suppressing flare gas burner of the present invention.

Referring now to the drawings, and particularly to FIG. 1, a typical flare stack which includes the smoke suppressing flare gas burner of the present invention is illustrated and generally designated by the numeral 10. The flare stack 10 can be positioned vertically and can include a lower conduit section 12 which is connected to the smoke suppressing flare gas burner 14. The lower conduit section 12 is of a size which will pass the maximum flow rate of gas to be flared and includes a closed bottom end or base 16 and a flange connector 18 at the top end. A flanged inlet connection 20 is provided adjacent the base 16.

Figure 3:
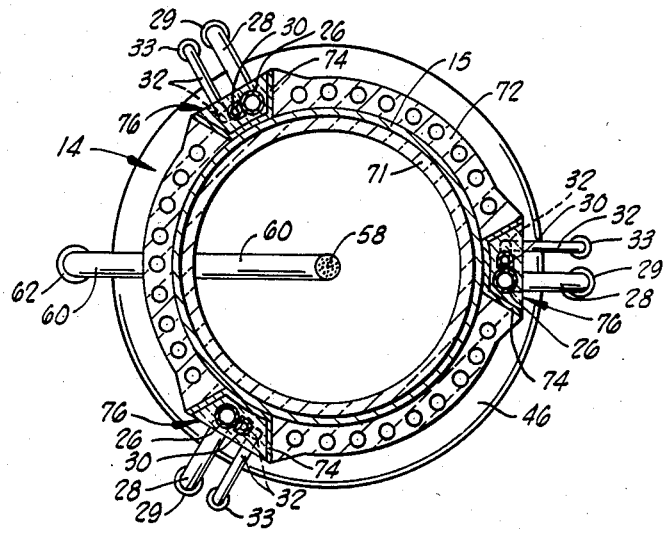
FIG. 3 is a cross-sectional view taken along line 3—3 of FIG. 2.
Figure 2:
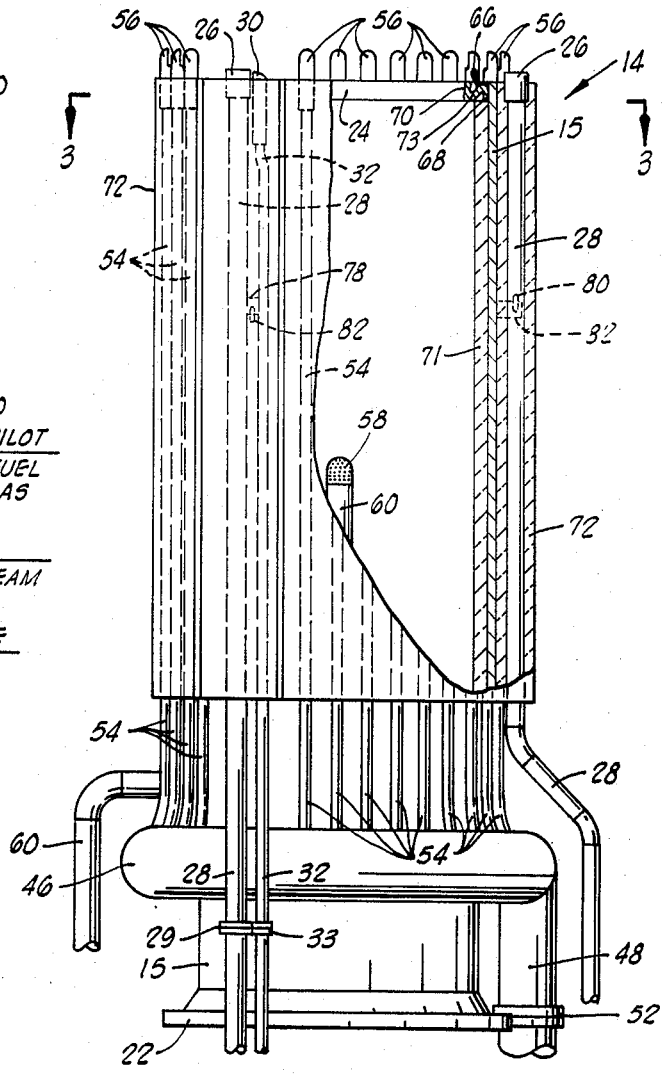
FIG. 2 is an enlarged partly sectional side elevational view of the smoke suppressing burner of FIG. 1.

Referring now to FIGS. 1-3, the flare gas burner 14 is comprised of a tubular member 15 having an inlet flange 22 at its lower end which is connected to the flange 18 of the conduit section 12 and an upwardly facing discharge opening 24 at the upper end thereof. Three pilot flame burners 26 are positioned around the periphery of the discharge opening 24 which are connected to conduits 28. Positioned adjacent the pilot flame burners 26 are ignitor heads 30 which are connected to conduits 32 extending to the bottom portion of the flare stack 10. The conduits 28 connect to air-fuel gas mixers 34 which are in turn connected to a fuel gas header 36 positioned at the bottom portion of the flare stack by conduits 38. Fuel gas header 36 includes a fuel gas inlet connection 40 connected thereto, and the header 36 is connected by a conduit 42 to an ignitor apparatus 44 which is in turn connected to the conduits 32. The conduits 28 include flange connections 29 therein and the conduits 32 include flange connections 33 which facilitate the installation or removal of the burner 14.

A smoke suppressant manifold 46 formed in a ring around the tubular member 15 is attached exteriorly of the tubular member adjacent the inlet end flange connector 22 thereof. The manifold 46 is connected to a conduit 48 for supplying smoke suppressant thereto which extends to the bottom portion of the stack 10 and has a flange connector 50 attached thereto. A flange connection 52 is provided in the conduit 48 adjacent the flange 22 of the tubular member 15. A plurality of conduits 54 are connected to the manifold 46 which extend exteriorly of the tubular member 15 to the upper end thereof. Connected to the conduits 54 around the periphery of the discharge opening 24 of the tubular member 15 are smoke suppressant discharge nozzles 56 which direct smoke suppressant inwardly and upwardly over the discharge opening 24.

A smoke suppressant discharge nozzle 58 may be disposed within the tubular member 15 connected to a conduit 60 which extends through a side of the tubular member 15 to the bottom portion of the stack 10. A flange connection 62 is provided in the conduit 60 adjacent the inlet flange 22 of the member 15 and a flange connector 64 is attached at the lower end thereof.

In operation of the flare stack 10, gas to be flared is conducted to the flare gas inlet 20 of the stack 10 from where it flows upwardly through the lower conduit section 12 and through the discharge opening 24 in the tubular member 15 of the burner 14 to the atmosphere. As the flare gas flows through the discharge opening 24 of the burner 14 into the atmosphere, it is ignited by the pilot flames continuously emitted from the pilot burners 26 and burned.

Fuel gas is supplied from a source thereof to the pilot fuel gas header 36 by way of the inlet connection 40 thereof. The fuel gas flows through the conduits 38 to the fuel gas-air mixers 34 wherein the fuel gas mixes with air and the resulting mixture flows by way of the conduits 28 to the pilot burners 26.

Pilot flames are continuously produced at the pilot burners so that whenever flare gas flows through the stack 10 and discharges from the burner 14, it is ignited and burned. When the pilot burners are initially ignited or when they have to be reignited, the ignitor system comprised of the ignitor heads 30 positioned adjacent the pilot flame burners 26, the conduits 32 and the ignitor apparatus 44 is utilized. That is, the ignitor apparatus 44 produces a fuel gas-air mixture which is ignited and caused to flow by way of the conduits 32 to the ignitor heads 30. When the burning gas-air mixture reaches and is discharged from the heads 30 adjacent the pilot flame burners 26, fuel-air mixtures emitted from the burners 26 are ignited thereby. As is well understood by those skilled in the art, various pilot flame ignitor systems and apparatus have been developed which are commercially available, any of which can be utilized with the flare stack 10.

The conduit 50 is connected to a source of smoke suppressant such as steam and conducts the smoke suppressant to the manifold 46. From the manifold 46 the smoke suppressant is conducted by the conduits 54 to the nozzles 56 which discharge streams of the smoke suppressant into the flare gas immediately downstream of the discharge opening 24 whereby smoke formation is suppressed. Also, if desired, a source of smoke suppressant is connected to the conduit 60 which conducts a stream thereof to the nozzle 58 within the tubular member 15. The smoke suppressant is discharged into flare gas flowing through the tubular member 15 whereby it mixes therewith and helps to suppress the formation of smoke.

While the flare stack 10 illustrated in FIG. 1 and described above is typical of a number of flare installations, it is to be understood that the smoke suppressing flare gas burner 14 of the present invention can be utilized in various other installations. For example, the burner 14 can be connected to the end of a conduit positioned vertically, horizontally or at an angle therebetween. Also, one or more burners 14 can be connected directly to a flare gas header.

Referring now specifically to FIGS. 2 and 3, the smoke suppressing flare gas burner 14 includes a flame retention device 66 attached to the discharge end of the tubular member 15. While the flame retention device can take various forms, the device 66 includes a cylindrical outer wall 68 connected to a cylindrical inner wall 70 by an undulated connecting wall 73. A plurality of ports (not shown) are disposed in the undulated connecting wall 73 and the inner wall 70 forms the discharge opening 24. The flame retention device 66 increases the velocity of the flare gases as they flow through the central opening 24 formed by the wall 70 and the portions of the flare gases flowing through the ports are burned adjacent the device 66 so that the burning of the main body of gases flowing through the central opening is maintained adjacent the device 66.

Disposed within the upper portion of the tubular member 15 and attached thereto is an internal protective liner 71 formed of refractory material. The term "refractory material" is used herein to mean any material having the ability to endure or resist high temperatures. An external protective covering 72 formed of refractory material is attached over the smoke suppressant conduits 54, the pilot fuel air conduit means 28, the ignitor conduit means 32 and over the upper portion of the exterior wall surface of the tubular member 15. The smoke suppressant discharge nozzles 56 are adjacent the top of the covering 72 around the discharge opening 24 of the burner 14. As mentioned above the nozzles 56 are designed and positioned to discharge streams of smoke suppressant, such as steam or a steam-air mixture, into the flare gas to inhibit smoke formation.

As best shown in FIG. 3, the exterior protective covering 72 includes three spaced apart longitudinal channels 74 formed therein. The channels 74 extend from the bottom of the covering 72 to the top thereof, and in the embodiment illustrated in FIG. 3, the external covering 72 is thickest at the locations of the channels 74 formed therein and thinnest at points intermediate the channels 74. This arrangement of the external covering is utilized to conserve refractory material where the diameter of the tubular member 50 is large.

Disposed within each of the channels 74 is an assembly 76 comprised of an upper portion of one of the conduits 28 attached to a pilot flame burner 26, an upper portion of one of the ignitor conduits 32 attached to an ignitor head 30 and a protective covering of refractory material surrounding the conduit portions. The refractory material covering is formed in a shape which is complementary to the cross-sectional shape of the channel 74 whereby an aerodynamically improved external surface is provided on the tubular member 15 adjacent the upper end portion thereof.

As shown in FIG. 2, each of the assemblies 76 is removably connected within a channel 74 by a lug 78 attached to and between the conduits 28 and 32 at a point near the upper end of the assembly 76 which fits into a vertical slot 80 formed in a second lug 82 positioned transversely to the lug 78 and attached to the tubular member 15. In order to allow the removal of the assemblies 76 and the replacement of burners or other parts thereof, the bolted flange connections or equivalent means 29 and 33 are provided in the conduits 28 and 32, respectively, at points below the assemblies 76. Thus, in order to remove an assembly 76 from the flare gas burner 14, the flange connections 29 and 33 in the conduits 28 and 32 are disconnected whereby the assembly 76 can be moved upwardly and outwardly to disengage the lug 78 from the lug 82.

In operation of the flare gas burner 14, if internal or external burning occurs as a result of a particular combination of wind and flare gas flow rate, the internal and external surfaces of the tubular member 15 as well as the conduits 28, 32 and 54 are protected from flame impingement, excessive heat, and other adverse conditions brought about by such burning. In addition, the external wall surface of the upper portion of the burner 14 is aerodynamically improved, i.e., conduits and other parts do not protrude outwardly from the sides thereof, whereby low pressure areas associated with such protrusions which promote external burning are eliminated. While the pilot flame burners 26, ignitor heads 30 and smoke suppressant nozzles 56 are partially exposed, the pilot flame burners 26 and ignitor heads 30 are easily replaced when necessary by temporarily removing the assemblies 76, replacing the parts and then reinstalling the assemblies 76. The smoke suppressant nozzles 56 are of rugged construction and are cooled by the flow of smoke suppressant therethrough. As a result, the nozzles 56 have a long service life. However, the nozzles 56 are removable from the conduits 54 and can be replaced if necessary.

As will be understood, the particular number of pilot flame burners utilized with the flare gas burner of this invention depends on a number of design factors such as the maximum flow rate of flare gas, prevailing wind conditions at the location of use, etc. Accordingly, this invention is not to be limited to any particular number of pilot flame burners, ignitors and associated conduit means.

In some applications of the flare gas burner of this invention, it is not necessary that the conduit means connected to ignitors and/or pilot flame burners be removable. In such applications, the pilot flame burner or burners and ignitor head or heads, if utilized, can be removed from the conduits connected thereto, but the conduits are permanently disposed within the external refractory covering as are the smoke suppressant conduits.

A technique which has been found to be particularly suitable in forming the external refractory covering with conduits permanently disposed within the covering is to form the covering encasing the conduits of a refractory material which is relatively soft and flexible followed by the forming of a hard inflexible outside refractory material covering thereover. The soft flexible material of the covering allows a limited movement of the conduits therewithin which is sometimes necessary during installation or operation.

In some applications such as where the maximum flow rate of gas to be flared by a burner of this invention is so low that the burner is of very small diameter, it is sometimes impossible or impractical to include an internal protective liner in the burner. In other circumstances, the characteristics of the application may be such that the use of an internal lining is not required. However, in such instances an external protective covering is attached to the burner and the pilot flame burner, ignitor and smoke suppressant conduits are disposed therewithin.

Thus, the present invention is well adapted to carry out the objects and attain the ends and advantages mentioned as well as those inherent therein. While numerous changes in the arrangement and construction of parts can be made by those skilled in the art, such changes are encompassed within the spirit of this invention as defined by the appended claims.

What is claimed is:

1. A flame impingement and heat shielded smoke suppressing flare gas burner comprising:

a tubular member having a flare gas discharge end and an inlet end adapted for connection to a source of flare gas;

a smoke suppressant manifold adapted for connection to a source of smoke suppressant positioned exteriorly of said tubular member;

a plurality of smoke suppressant conduits connected to said manifold and extending exteriorly of said tubular member adjacent the discharge end portion thereof for discharging smoke suppressant;

pilot flame burner means for igniting flare gas discharged from said tubular member positioned adjacent the discharge end thereof;

pilot fuel conduit means for supplying fuel to said pilot flame burner means connected to said burner means and extending exteriorly of said tubular member to the inlet end thereof; and an external protective covering formed of refractory material attached over said plurality of smoke suppressant conduits, over said pilot fuel conduit means and over the exterior wall surface of said tubular member at the discharge end portion thereof whereby said exterior wall surface, said smoke suppressant conduits and said pilot fuel conduit means are shielded by said protective covering and an aerodynamically improved external discharge end portion is provided on said tubular member.

2. The burner of claim 1 wherein said pilot flame burner means are removably attached to said pilot fuel conduit means.

3. A flame impingement and heat shielded smoke suppressing flare gas burner comprising:

a tubular member having a flare gas discharge end and an inlet end adapted for connection to a source of flare gas;

an internal protective liner formed of refractory material attached within said tubular member at the discharge end portion thereof;

a smoke suppressant manifold adapted for connection to a source of smoke suppressant positioned exteriorly of said tubular member;

a plurality of smoke suppressant conduits connected to said manifold and extending exteriorly of said tubular member adjacent the discharge end portion thereof for discharging smoke suppressant into flare gas at said discharge end;

pilot flame burner means for igniting flare gas discharged from said tubular member positioned adjacent the discharge end thereof;

pilot fuel conduit means for supplying fuel to said pilot flame burner means connected to said burner means and extending exteriorly of said tubular member to the inlet end thereof; and an external protective covering formed of refractory material attached over said plurality of smoke suppressant conduits, over said pilot fuel conduit means and over the exterior wall surface of said tubular member at the discharge end portion thereof whereby said exterior wall surface, said smoke suppressant conduits and said pilot fuel conduit means are shielded by said protective covering and an aerodynamically improved external discharge end portion is provided on said tubular member.

4. The burner of claim 3 wherein said pilot flame burner means are removably attached to said pilot fuel conduit means and said conduit means are removably disposed within said external protective covering.

5. A flame impingement and heat shielded smoke suppressing flare gas burner adapted to be mounted at the end of a flare gas conduit comprising:

a tubular member having a flare gas discharge end and an inlet end, the inlet end being adapted to be connected to said flare gas conduit;

an internal protective covering formed of refractory material attached within said tubular member whereby at least the interior walls of said tubular member adjacent the discharge end thereof are covered thereby;

a smoke suppressant manifold adapted for connection to a source of smoke suppressant positioned exteriorly of said tubular member;

a plurality of smoke suppressant conduits connected to said manifold and extending exteriorly of said tubular member adjacent the discharge end thereof for discharging smoke suppressant into flare gas at said discharge end;

an external protective covering formed of refractory material attached over said plurality of smoke suppressant conduits and over the exterior wall surface of said tubular member at the discharge end portion thereof whereby said wall surface and said conduits are shielded, said covering including at least one longitudinal channel formed therein;

pilot fuel conduit means having a protective covering of refractory material attached thereto removably disposed in said channel whereby said conduit means are shielded and an aerodynamically improved external surface is provided on said tubular member; and pilot flame burner means positioned adjacent the discharge end of said tubular member removably attached to said conduit means.

6. The flare gas burner of claim 5 which is further characterized to include pilot burner ignition conduit means having a protective covering of refractory material attached thereto also removably disposed in said channel.

7. The flare gas burner of claim 6 wherein said pilot burner conduit means and said ignition conduit means have a mutual protective covering of refractory material attached thereto formed in a cross-sectional shape complementary to the shape of the channel within which it is disposed.

8. The flare gas burner of claim 5 wherein said smoke suppressant manifold is formed in a ring disposed around and attached to said tubular member.

9. The flare gas burner of claim 5 wherein said protective covering attached to said pilot burner conduit means is formed in a cross-sectional shape complementary to the shape of the channel within which it is disposed.

10. In a tubular flare gas burner having a flare gas discharge end and an inlet end adapted to be mounted to a flare gas conduit, the improvement whereby said burner is less susceptible to damage caused by internal and/or external burning comprising:

an internal protective liner formed of refractory material attached within at least the discharge end portion of said burner whereby the internal wall surface of said burner is shielded from flame impingement and excessive heat caused by internal burning;

a smoke suppressant manifold adapted for connection to a source of smoke suppressant positioned exteriorly of said burner;

a plurality of smoke suppressant conduits connected to said manifold and extending exteriorly of said burner adjacent the discharge end portion thereof for discharging smoke suppressant into flare gas at said discharge end;

an external protective covering formed of refractory material attached over said plurality of smoke suppressant conduits and over the exterior wall surface of said burner at the discharge end portion thereof whereby said conduits and the external surface of said burner are substantially shielded from flame impingement and excessive heat caused by external burning; and pilot burner means positioned adjacent the discharge end of said burner with fuel supply and ignitor conduit means extending thereto, said conduit means being disposed within said external protective covering whereby said conduit means are also shielded thereby and an aerodynamically improved external discharge end portion is provided on the discharge end portion of said burner.

11. In a tubular flare gas burner having a flare gas discharge end and an inlet end adapted to be mounted to a flare gas conduit, the improvement whereby said burner is less susceptible to damage caused by internal and/or external burning comprising:

an internal protective liner formed of refractory material attached within at least the discharge end portion of said burner whereby the internal wall surface of said burner is shielded from flame impingement and excessive heat caused by internal burning;

a smoke suppressant manifold adapted for connection to a source of smoke suppressant positioned exteriorly of said burner;

a plurality of smoke suppressant conduits connected to said manifold and extending exteriorly of said burner adjacent the discharge end portion thereof for discharging smoke suppressant into flare gas at said discharge end;

an external protective covering formed of refractory material attached over said plurality of smoke suppressant conduits and over the exterior wall surface of said burner at the discharge end portion thereof whereby said conduits and the external surface of said burner are substantially shielded from flame impingement and excessive heat caused by external burning, said external protective covering including at least one channel formed therein; and pilot burner means positioned adjacent the discharge end of said burner with fuel supply and ignitor conduit means extending thereto, said conduit means being disposed within said channel formed in said external protective covering whereby said conduit means are also shielded thereby and an aerodynamically improved external discharge end portion is provided on the discharge end portion of said burner.

12. The burner of claim 11 wherein said fuel supply and ignitor conduit means have a protective covering of refractory material attached thereto of a shape complementary to the shape of said channel.

13. The burner of claim 12 wherein said conduit means and protective covering attached thereto are removably disposed in said channel.

* * * * *